United States Patent [19]

Luperti et al.

[11] Patent Number: 4,898,570

[45] Date of Patent: Feb. 6, 1990

[54] METHOD AND APPARATUS FOR HALF FOLDING PAPER SHEETS

[75] Inventors: Harry E. Luperti, Bethel; Robert Irvine, Riverside; Anthony Luvara, Stamford, all of

[73] Assignee: Pitney Bowes, Stamford, Conn.

[21] Appl. No.: 309,022

[22] Filed: Feb. 8, 1989

Related U.S. Application Data

[63] Continuation of Ser. No. 95,695, Sep. 19, 1987, abandoned.

[51] Int. Cl.[4] ..... B65H 45/14; B65H 45/24

[52] U.S. Cl. ..... 493/420; 493/421; 270/45; 270/46

[58] Field of Search ..... 493/419, 420, 421; 270/45, 46

[56] References Cited

U.S. PATENT DOCUMENTS

| | | | |
|---|---|---|---|
| 269,186 | 12/1882 | Crowell | 270/46 |
| 2,023,531 | 12/1935 | Kleinschmit et al. | 493/420 |
| 2,807,463 | 9/1957 | Smith | 493/421 |
| 3,975,009 | 8/1976 | Brown | 493/421 |
| 4,223,882 | 9/1980 | Stocker | 270/45 |
| 4,295,642 | 10/1981 | Kelly | 270/53 |
| 4,456,242 | 6/1984 | Morin | 271/94 |
| 4,607,831 | 8/1986 | Raybuck | 270/58 |
| 4,616,815 | 10/1986 | Vijuk | 270/45 |
| 4,621,966 | 11/1986 | Luperti et al. | 414/43 |
| 4,629,175 | 12/1986 | Fischer et al. | 271/202 |

FOREIGN PATENT DOCUMENTS

| | | | |
|---|---|---|---|
| 226037 | 6/1943 | Switzerland | 493/420 |

*Primary Examiner*—Frederick R. Schmidt
*Assistant Examiner*—William E. Terrell
*Attorney, Agent, or Firm*—Charles R. Malandra, Jr.; Melvin J. Scolnick; David E. Pitchenik

[57] ABSTRACT

Method and apparatus for half folding sequentially and nesting a plurality of paper sheets. The apparatus includes a buckle chute folder, the folder having a first pair of feed rollers rotatable at a given velocity, and a device for continuously feeding the paper sheets in shingled relationship at a second velocity greater than the given velocity to the feed rollers. The shingled relationship is defined by an overlap of the sheets of at least one-half of the length of the sheets. By using the apparatus and method, any desired number of sheets may be folded sequentially and nested one inside the other.

8 Claims, 4 Drawing Sheets

Fig. 4.
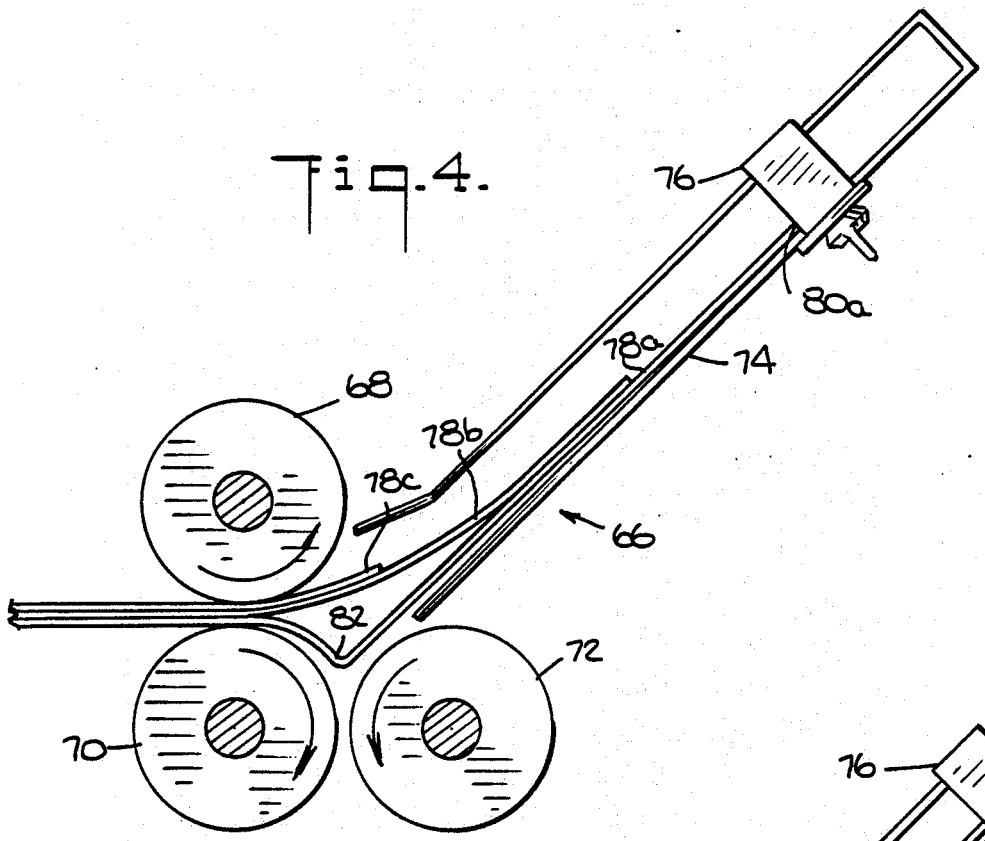
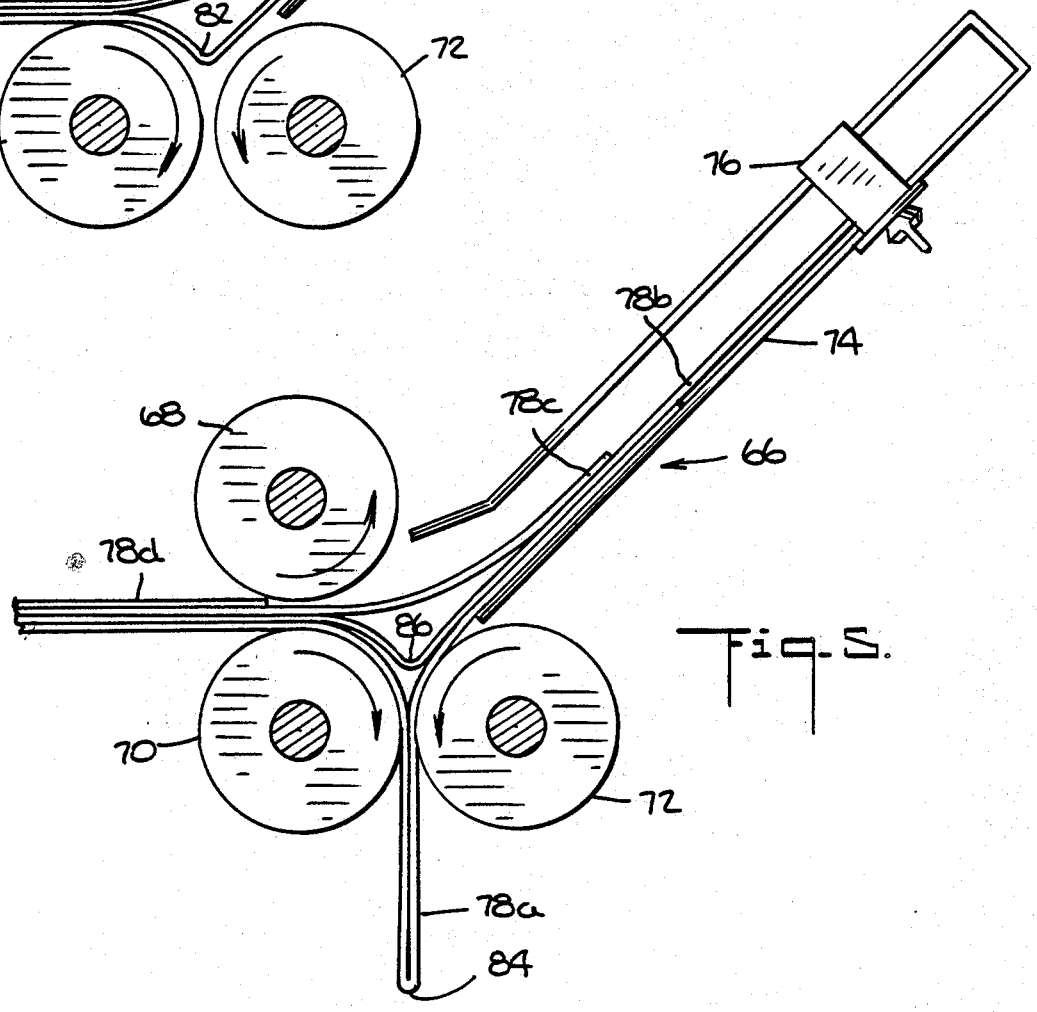
Fig. 5.

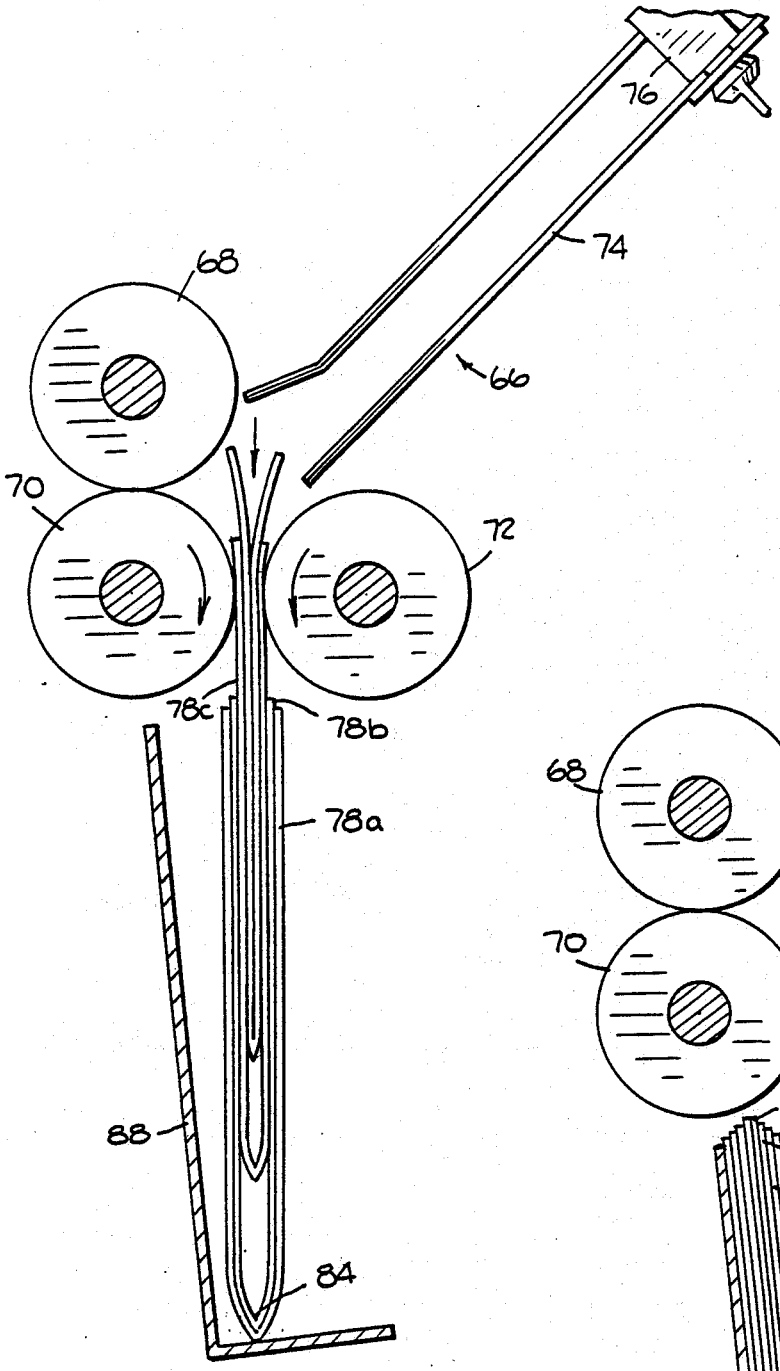
Fig. 6.
Fig. 7.
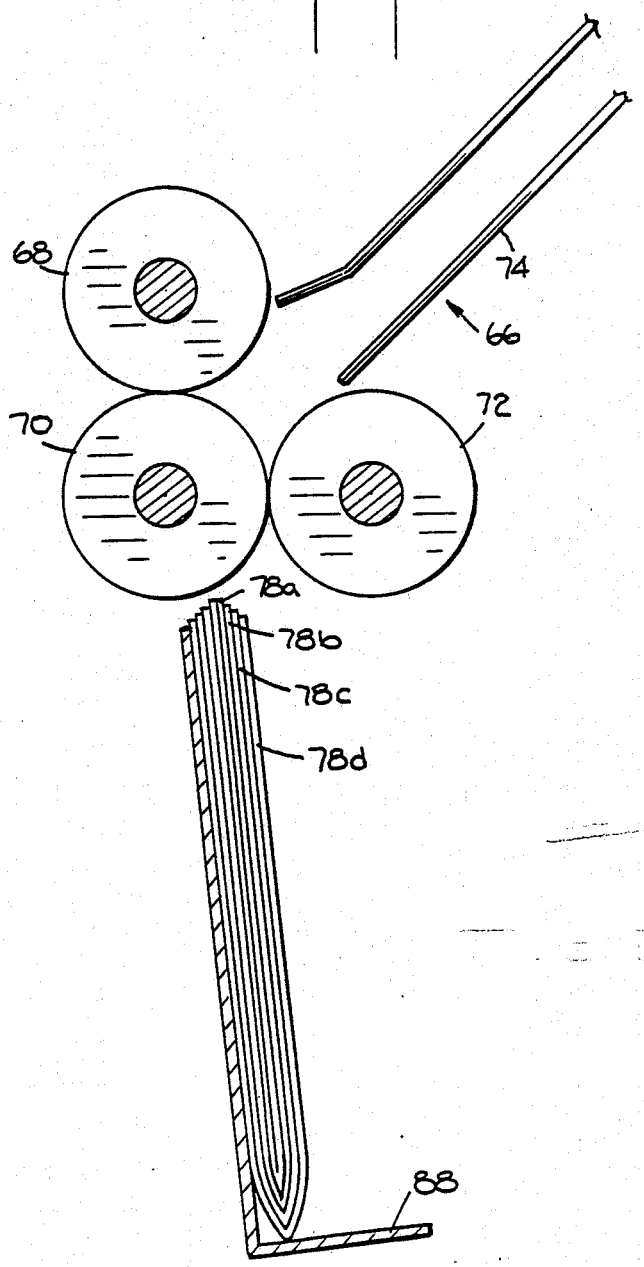

METHOD AND APPARATUS FOR HALF FOLDING PAPER SHEETS

This application is a continuation of application Ser. No. 095,695, filed 9/14/87 abandoned.

BACKGROUND OF THE INVENTION

The instant invention relates to folding sheets of paper with buckle chutes, and more particularly to sequential folding in half by a buckle chute of a plurality of sheets of paper and the subsequent nesting of the folded sheets of paper into a packet and the insertion of the packet into an envelope.

There presently exists a need in the area of folding of paper sheets by means of buckle chute folders to be able to fold together a relatively large number, such as 10, 20, 30 or more, or paper sheets or documents. This requirement comes about by virtue of businesses, such as utilities or banks or retail stores, having large statements or bills which in many cases may exceed 30 more sheets of paper, most or all of which may need to be folded in order to be inserted into an envelope for mailing to a customer. Typically, the feeding of the sheets of paper, the folding of the sheets of paper, and the insertion of the folded sheets of paper into the envelope are effected by an inserting system comprising documents feeders, conveyors, buckle chute folders and envelope feeders.

A critical limitation with the aforesaid state of the art inserting system is the inability to fold a large number of sheets together simultaneously, in large part due to the high speed of these systems. Some of the most critical limitations are the noise of the sheets of paper entering and leaving the folding rollers and the tremendous force required to maintain pressure of the folding rollers relative to each other as they separate to accept a large number of sheets together.

It is therefor extremely desirable to have a practical solution to the foregoing problem of folding a large number of sheets simultaneously. The instant invention provides such a solution by providing apparatus and a method for half-folding a plurality of paper sheets sequentially and subsequently nesting the half-folded sheets and thereby attaining a result which in terms of quality of fold is superior to simultaneous folding of the same large number of sheets.

SUMMARY OF THE INVENTION

The instant invention accordingly provides apparatus and a method for half-folding sequentially and nesting a plurality of paper sheets. The apparatus includes a buckle chute folder, the folder having a first pair of feed rollers rotatable at a given velocity, and means for continuously feeding the paper sheets in shingled relationship at a velocity greater than the given velocity to the feed rollers. The shingled relationship is defined by an overlap of the sheets of about one quarter but less than one half of the length of the sheets, whereby any desired number of sheets may be folded sequentially and nested one inside the other.

BRIEF DESCRIPTION OF THE DRAWINGS

FIG. 4 is a side elevational view of the buckle chute folder seen in FIG. 1 showing a first, second and third sheet of paper in progressive stages preparatory to half-folding;

FIG. 5 is similar to FIG. 2 except that the first sheet of paper has been half-folded and a second sheet of paper is about to be half-folded while the third sheet of paper is still entering the buckle chute;

FIG. 6 is similar to FIG. 3 except that a collecting bin is shown beneath the buckle chute for receiving the half-folded and nesting sheets of paper;

FIG. 7 is similar to FIG. 4 except that the half-folded sheets of paper are shown as having been completely nested and assembled into a packet of sheets.

DETAILED DESCRIPTION

Figure 1:
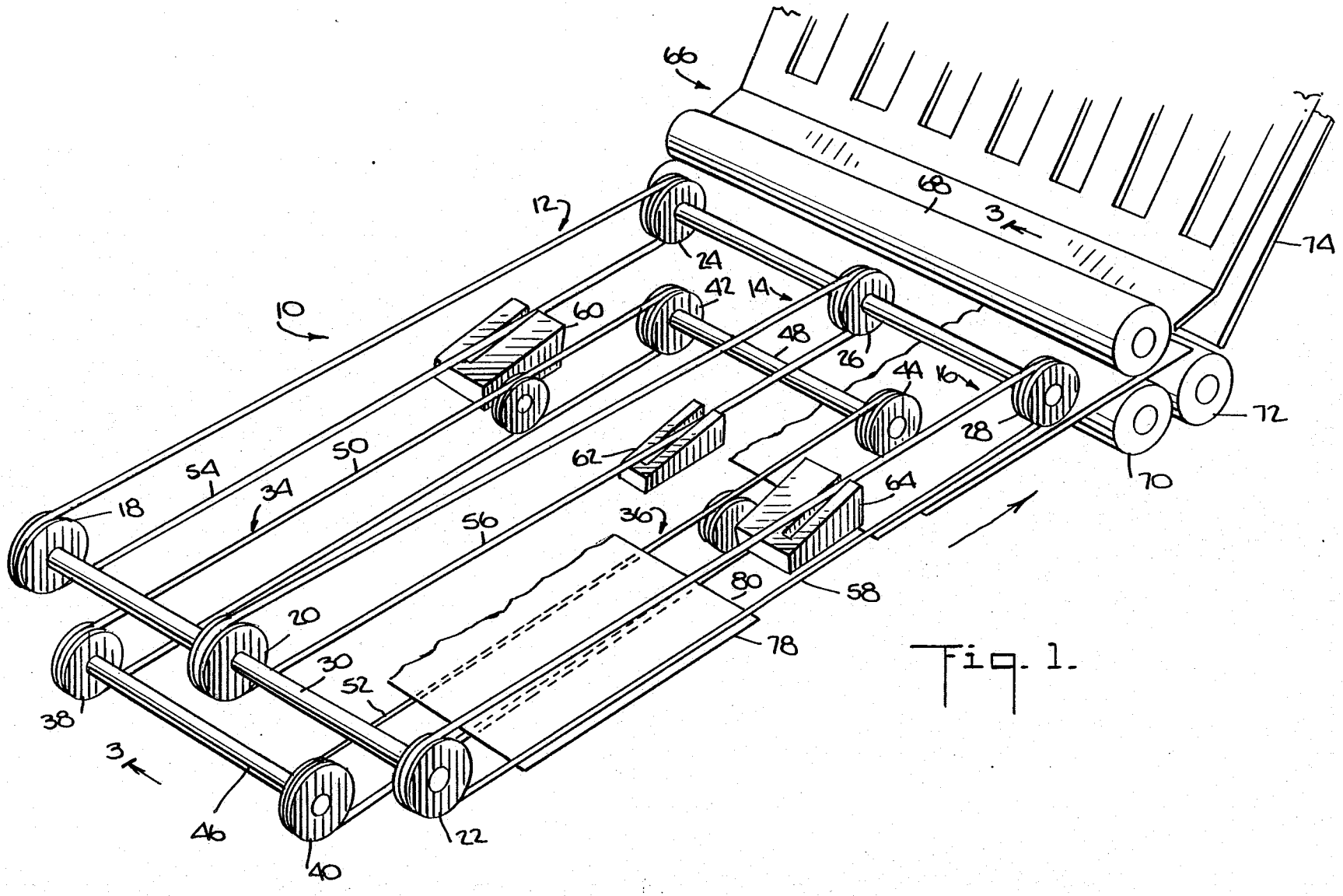
FIG. 1 is a perspective view of a shingling conveyor in combination with a buckle chute folder in accordance with the instant invention.
Figure 2:
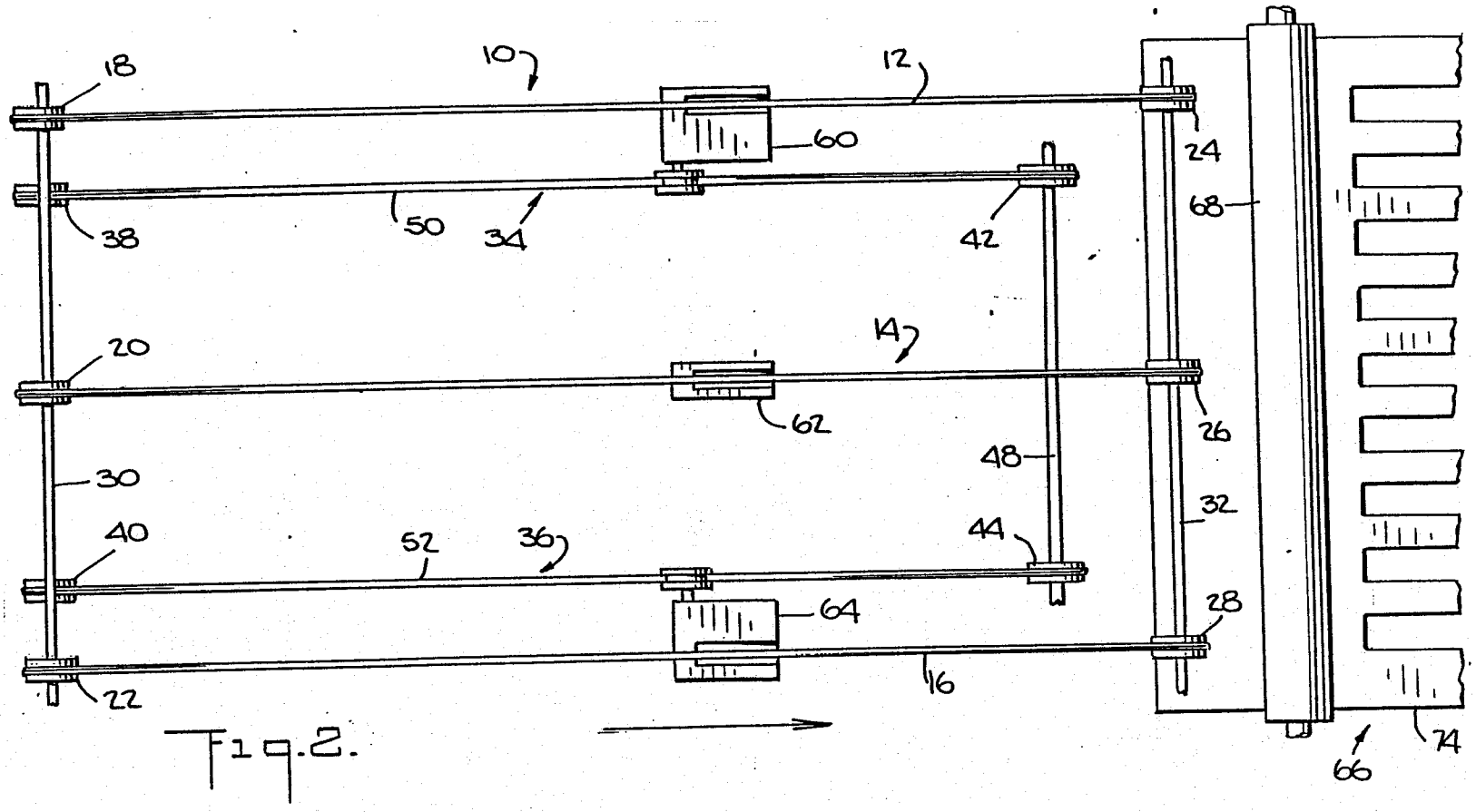
FIG. 2 is a top plan view of the apparatus seen in FIG. 1.
Figure 3:
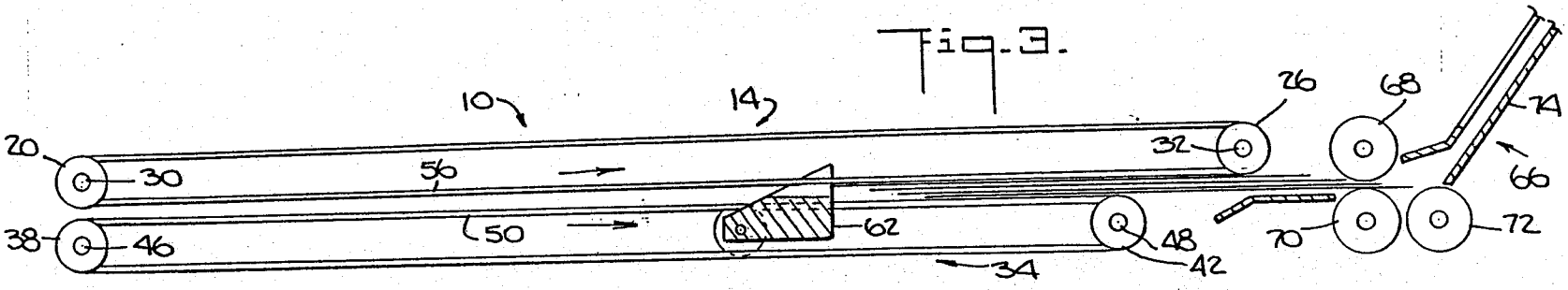
FIG. 3 is a side elevational view of the apparatus seen in FIGS. 1 and 2.

In describing the preferred embodiment of the instant invention, reference is made to the drawings wherein there is seen in FIGS. 1–3 a conveyor-accumulator 10 consisting of three upper belts 12, 14 and 16 mounted on driven pulleys 18, 20 and 22 respectively and on idler pulleys 24, 26 and 28 respectively. The driven pulleys 18, 20 and 22 are fixedly mounted on a drive shaft 30 which is driven by a motor (not shown). The idler pulleys 24, 26 and 28 are rotatably mounted on a shaft 32 journalled in the frame (not shown) of the conveyor-accumulator 10. The conveyor-accumulator 10 typically is part of a total folding and inserting system.

The conveyor-accumulator 10 further includes immediately below the upper belts 12, 14 and 16 a pair of lower belts 34 and 36 mounted on driven pulleys 38 and 40 respectively and on idler pulleys 42 and 44 respectively. The belts 12, 14, 16, 34 and 36 are preferably "0" ring belts. The driven pulleys 38 and 40 are fixedly mounted on a drive shaft 46 which is driven by a motor (not shown) and the idler pulleys 42 and 44 are rotatably mounted on a shaft 48. As best seen in FIG. 3, the upper reaches 50 and 52 of the lower belts 34 and 36 respectively are situated immediately below the lower reaches 54, 56 and 58 of the upper belts 12, 14 and 16 respectively. As best seen in FIG. 2, a plan view, the lower belt 34 is situated between the upper belts 12 and 14 and the lower belt 36 is situated between the upper belts 14 and 16.

Three sheet elevating ramps 60, 62 and 64 are rigidly suspended below the lower reaches 54, 56 and 58 of the upper belts 12, 14 and 16 respectively along a conveying path moving in the direction of the arrows seen in FIGS. 1–3. The functioning of the ramps 60, 62 and 64 and of the entire conveyor-accumulator 10 will be explained in additional detail hereinbelow.

Located downstream of the accumulator-conveyor 10 is a conventional buckle chute folder generally designated 66 consisting of a first pair of feed rollers 68 and 70 and a third feed roller 72 which cooperates with the roller 70 to form a second pair of feed rollers. The buckle chute folder 66 also includes a conventional buckle chute 74 having a stopping bar 76 therein (see FIGS. 4–6).

In operation, the conveyor-accumulator 10 feeds seriatim a stream of sheets 78 which have been separated from a stack (not shown) of sheets upstream by a singulating device (not shown) between the lower reaches 54, 56 and 58 of the upper belts 12, 14 and 16 respectively and the upper reaches 50 and 52 of the lower belts 34 and 36 respectively at a desired velocity consistent with the overall folding and inserting system of which the conveyor-accumulator 10 is a component. The sheets 78, as they are fed seriatim by the conveyor-accumulator 10, encounter the three sheet elevating ramps 60, 62 and 64 whose upstream portions intercept the leading end 80 of the sheet 78 (see FIG. 1) to thereby cause the sheets 78 to become slightly elevated. This slight elevation results in each sheet 78 being deposited upon the preceding sheet 78 downstream of the ramps 60, 62 and 64 and upstream of the feed rollers 68 and 70 which function similar to a registration device in that their slow speed results in the sheets 78 being slowed considerably after leaving the conveyor-accumulator 10. The buckle chute folder 66 has its stopping bar 76 positioned so that the sheets 78 are folded in half, and in order to achieve this half fold, it is necessary that the sheets 78 have a shingled relationship to each other prior to entering the feed rollers 68 and 70. A shingled relationship is defined to mean a plurality of sheets whose leading or downstream ends are offset from on another, so that their leading or downstream ends are not aligned to form a vertical plane. It has been found that in creating the half fold, a shingled relationship in which the overlap of one sheet to the adjacent sheet is at least one half of the length of the sheet is required. Achieving this overlap is effected by having the sheets 78 moved through feed rollers 68 and 70 at a speed between about 5 to 40% that of the speed the sheets 78 are moved by the conveyor-accumulator 10, the preferred range being between about 10 and 20%. For example, if the accumulator-conveyor 10 is moving the sheets 78 at the speed of 100 inches per second, then the rollers 68 and 70 should move the sheets 78 at a speed of about 5 to 40 inches per second (preferably between about 10 to 20 inches per second) to produce overlapping of the sheets prior to their entry into the nip of the rollers 68 and 70 of between about three quarters and one half of their length. It should be noted that sufficient shingling can be effected by almost any differences in speed between the conveyor-accumulator 10 and the roller 68 and 70; e.g. a 1% difference in speed can work although such a small differential may not be commercially feasible.

The result of the sheets 78 being shingled as described above prior to entry into the nip of the feed rollers 68 and 70 is illustrated in FIGS. 4–7. The pressure of the feed rollers 68 and 70 feeds the sheets 78 into the buckle chute 66 toward the stopping bar 76. As the leading edge 80*a* of the sheet 78*a* is stopped by the buckle chute stopping bar 76, as seen in FIG. 4, a buckle 82 is formed in the middle of the sheet 78*a* towards the nip of the rollers 70 and 72. The succeeding sheets 78*b*, 78*c*, 78*d*, etc. continue to enter the buckle chute 66 and are not affected by the buckling and folding of the sheet 78*a*.

As seen in FIG. 5, continued feeding of the sheet 78*a* by the roller pair 70 and 72 causes a fold 84 to be formed in the location of the buckle 82 once the buckle area 82 exits the nip of the rollers 70 and 72. Simultaneously, as seen in FIG. 5, a buckle 86 is being formed in the succeeding sheet 78*b* so that sheet 78*b* is being folded inside preceding sheet 78*a* as the sheet 78*a* exits the rollers 70 and 72. As clearly seen in FIGS. 4–7, only one sheet at a time is being folded, and as best seen in FIG. 6, after the sheets 78 exit the rollers 70 and 72 they nest inside one another, as they enter a guide platform 88 which holds the nested packet of sheets 78, which in the case seen in the drawings, consists of four sheets 78 *a–d*. As seen in FIG. 7, once the four sheets 78 *a–d* have exited the nip of the rollers 70 and 72, all of the four sheets 78 *a–d* rest against the platform 88 remote from the rollers 70 and 72.

Once the sheets 78 *a–d* are accumulated on the platform 88, they are removed by conventional means and may be inserted into an envelope (not shown). It can be appreciated that there is virtually no limit to the number of sheets 78 which may be folded and nested inside each other, but there is a practical limitation imposed by the thickness of the envelope.

Although the invention has been described in conjunction with the foregoing specific embodiment, many alternatives, variations and modifications will be apparent to those of ordinarily skill in the art. Those alternatives, variations and modifications are intended to fall within the spirit and scope of the appended claims.

What is claimed is:

1. Apparatus for half folding sequentially and nesting a plurality of paper sheets, comprising:

a buckle chute folder having a pair of feed rollers rotating at a given velocity, said rollers forming an entrance nip to said buckle chute folder;

means for feeding said plurality of paper sheets seriatim along a path toward said feed rollers at a second velocity greater than said given velocity; and means situated within said path for causing a succeeding paper sheet of said plurality to become shingled relative to a preceding paper sheet of said plurality prior to said succeeding paper sheet entering the nip of said feed rollers, thereby forming a shingled stream entering said entrance nip to said buckle chute folder, whereby any desired number of said sheets may be folded in half and nested one inside the other sequentially.

2. The apparatus of claim 1, wherein said given velocity is between about 5 to 40% of the second velocity.

3. The apparatus of claim 2, wherein said given velocity is between about 10 to 20% of the second velocity.

4. The apparatus of claim 1, wherein the shingled relationship comprises an overlap of at least one half of the length of said sheets.

5. A method of half folding sequentially and nesting a plurality of paper sheets, comprising:

feeding at a given velocity said plurality of paper sheets seriatim along a path toward a buckle chute folder having a pair of feed rollers rotating at a second velocity less than said given velocity, said rollers forming an entrance nip to said buckle chute folder;

causing a succeeding paper sheet of said plurality to become shingled relative to a preceding paper sheet of said plurality prior to said succeeding paper sheet entering the nip of said feed rollers;

continuously feeding said shingled paper sheets into said buckle chute folder at said second velocity, thereby forming a shingled stream entering said entrance nip to said buckle chute folder; and collecting said half folded sheets in nested relationship, whereby any desired number of said sheets may be folded in half and nested one inside the other sequentially.

6. The method of claim 5, wherein said second velocity is between about 5 to 40% of the given velocity.

7. The method of claim 6, wherein said second velocity is between about 10 to 20% of the given velocity.

8. The method of claim 5, wherein the shingled relationship comprises an overlap of at least one half of the length of said sheets.

* * * * *